United States Patent [19]

Parnell

[11] Patent Number: 4,995,681

[45] Date of Patent: Feb. 26, 1991

[54] BUILT-IN IRONING CENTER

[75] Inventor: Clyde B. Parnell, Godwin, N.C.

[73] Assignee: Fasco Industries, Inc., Lake Forest, Ill.

[21] Appl. No.: 405,201

[22] Filed: Sep. 11, 1989

[51] Int. Cl.[5] ..... A47B 5/00

[52] U.S. Cl. ..... 312/242; 38/103; 38/139; 108/103; 108/48

[58] Field of Search ..... 312/242; 108/47, 35, 108/39, 40, 48, 103; 38/103, 112, 138, 139

[56] References Cited

U.S. PATENT DOCUMENTS

| | | | |
|---|---|---|---|
| 1,300,993 | 4/1919 | Miller | 38/139 |
| 1,563,044 | 11/1925 | Sanders | 38/139 |
| 1,696,145 | 12/1928 | Wagoner | 108/48 |
| 2,014,549 | 9/1935 | Behm | 108/48 |
| 2,783,562 | 3/1957 | Smith | 38/139 |
| 3,185,278 | 5/1965 | Miller et al. | 38/107 |
| 4,155,609 | 5/1979 | Skafte | 312/245 |
| 4,480,556 | 11/1984 | Wilson | 38/103 |

FOREIGN PATENT DOCUMENTS

| | | | |
|---|---|---|---|
| 0589552 | 12/1959 | Canada | 108/39 |

*Primary Examiner*—Laurie K. Cranmer

*Assistant Examiner*—Gerald A. Anderson

*Attorney, Agent, or Firm*—Shlesinger, Fitzsimmons & Shlesinger

[57] ABSTRACT

A two-piece, foldable ironing board is pivotally mounted at one end thereof for folding movement into and out of a cabinet, which is disposed to be mounted in a rectangular recess in the wall of a kitchen, or the like. The board is formed in two, separate sections which are hingedly connected together by a pair of double-acting hinges, which permit the two sections of the board to be folded between an operative position in which they lie in a substantially common, horizontal plane, or an inoperative position in which one section is folded back over the other. One section of the board is mounted for rotational movement about the axis of a lazy susan-type support, which is carried on the outer end of an ironing board support plate. The inner end of this support plate is pivotally connected to the side walls of the cabinet for swinging movement into and out of the cabinet between collapsed and erected positions, respectively, and also is adjustable vertically into several different positions in which it correspondenly supports the ironing board in one of several different vertical positions when the ironing board is in use.

8 Claims, 3 Drawing Sheets

BUILT-IN IRONING CENTER

BACKGROUND OF THE INVENTION

This invention relates to a built-in or self-contained ironing center, and more particularly to a foldable ironing board and associated housing or cabinet which is designed to be mounted in or on a kitchen wall, or the like.

Heretofore efforts have been made to provide foldable, compact ironing boards which can be utilized in small or rather cramped areas. U.S. Pat. No. 1,563,044, for example, discloses a wall-mounted, folded ironing board which comes in two sections, one of which is mounted on the wall, and the other section of which is pivotally connected to the wall-mounted section. The U.S. Pat. Nos. 671,164, 1,696,145, 2,014,549 and 4,480,556, also disclose wall-mounted ironing boards, at least certain of which are mounted to swivel about a vertical axis so that they can be used in a form in which they either project at right angles from the wall, or can be swung so that they extend generally parallel to the wall.

Furthermore, some efforts have been made to place the foldable ironing board within a cabinet, which in turn, is mounted in or on a wall, as suggested in U.S. Pat. No. 3,185,278.

Missing from these prior art devices, however, is a cabinet which contains not only a foldable ironing board, but also other features which, not only enable the position of the board to be adjusted to accommodate operators of different height, but which also include provision for other items which considerably ease the chore of ironing.

It is an object of this invention, therefore, to provide an improved, built-in ironing unit or center, which includes all of the features necessary to permit the actual ironing operation to be performed in very small or cramped spaces.

Still another object of this invention is to provide an ironing unit or center of the type described which includes a foldable ironing board, which can be collapsed into a housing or cabinet, which, in turn, can be mounted in or on a kitchen or hallway wall, or the like.

Still other objects of the invention will be apparent hereinafter from the specification and from the recital of the appended claims, particularly when read in conjunction with accompanying drawings.

SUMMARY OF THE INVENTION

An elongate, rectangular cabinet, which is adapted to be mounted in a recess in the wall of a kitchen, or the like, contains an ironing board support plate pivotally and adjustably connected at its lower end in the cabinet for swinging movement between a collapsed position within the cabinet, and an erected position in which it projects at right angles out of the cabinet. Mounted on a lazy susan-type support on the outer end of the erected support plate is the inner section of a two-piece, foldable ironing board. The outer section of the board is hingedly connected to the inner section by two sets of double acting hinges, which permit the outer section to be folded into a collapsed position in which it overlies the inner section, or an erected position in which it is disposed in coplanar relation with the inner section.

The lazy susan-type mount permits the erected ironing board to be swung 180° about a vertical axis relative to the ironing board support plate. Also, the cabinet contains a lamp, power supply socket and a safety switch which deenergizes the lamp and socket when the cabinet door is closed.

THE DRAWINGS

Figure 3:
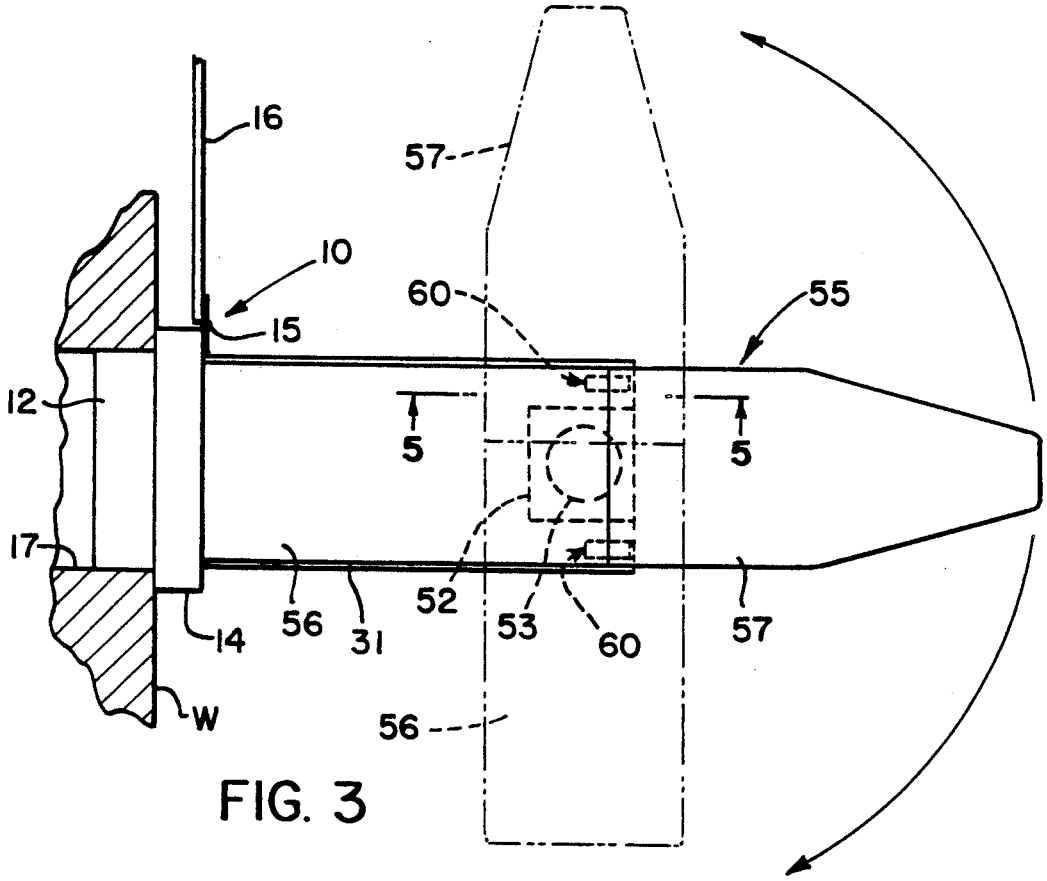
Figure 4:
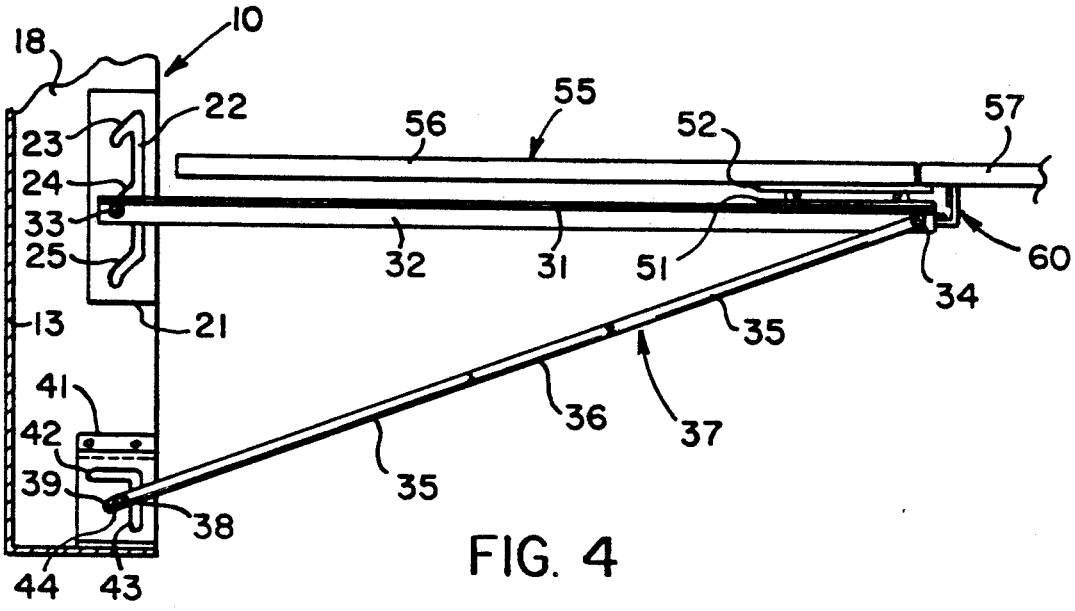
Figure 5:
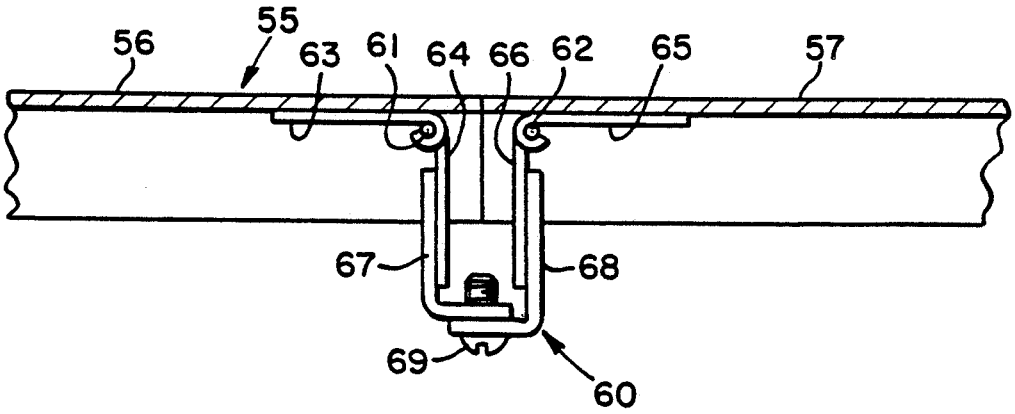
Figure 6:
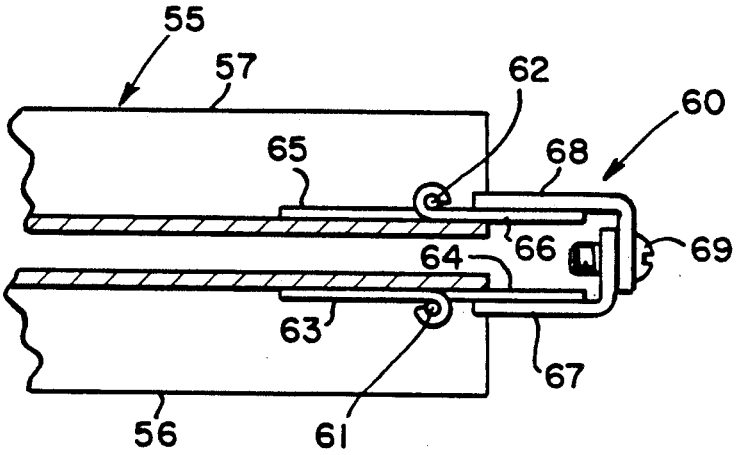

FIG. 3 a fragmentary plan view of the wall-mounted cabinet with its door opened and its associated ironing board folded outwardly into its erected position;

FIG. 4 is a fragmentary side elevational view of this cabinet and its erected ironing board on a somewhat larger scale, with the cover of the ironing board removed, and portions of the board shown in section;

FIG. 5 is a greatly enlarged, fragmentary sectional view taken generally along the line 5—5 in FIG. 3 looking in the direction of the arrows, and illustrating the two sections of the ironing board in their unfolded or erected positions; and FIG. 6 is a fragmentary side elevational view similar to FIG. 5, but illustrating the two sections of the ironing board in their folded or collapsed position.

DETAILED DESCRIPTION OF THE PREFERRED EMBODIMENTS

Figure 2:
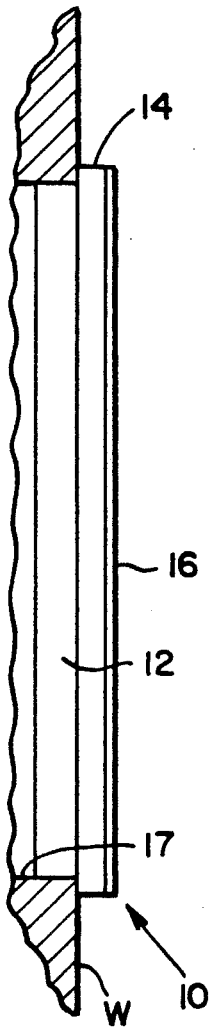
FIG. 2 is a fragmentary sectional view on a somewhat smaller scale illustrating the cabinet as it would appear when mounted in a recess in a room wall with its associated ironing board collapsed into the cabinet, and with the front door of the cabinet being shown in its closed position.
Figure 1:
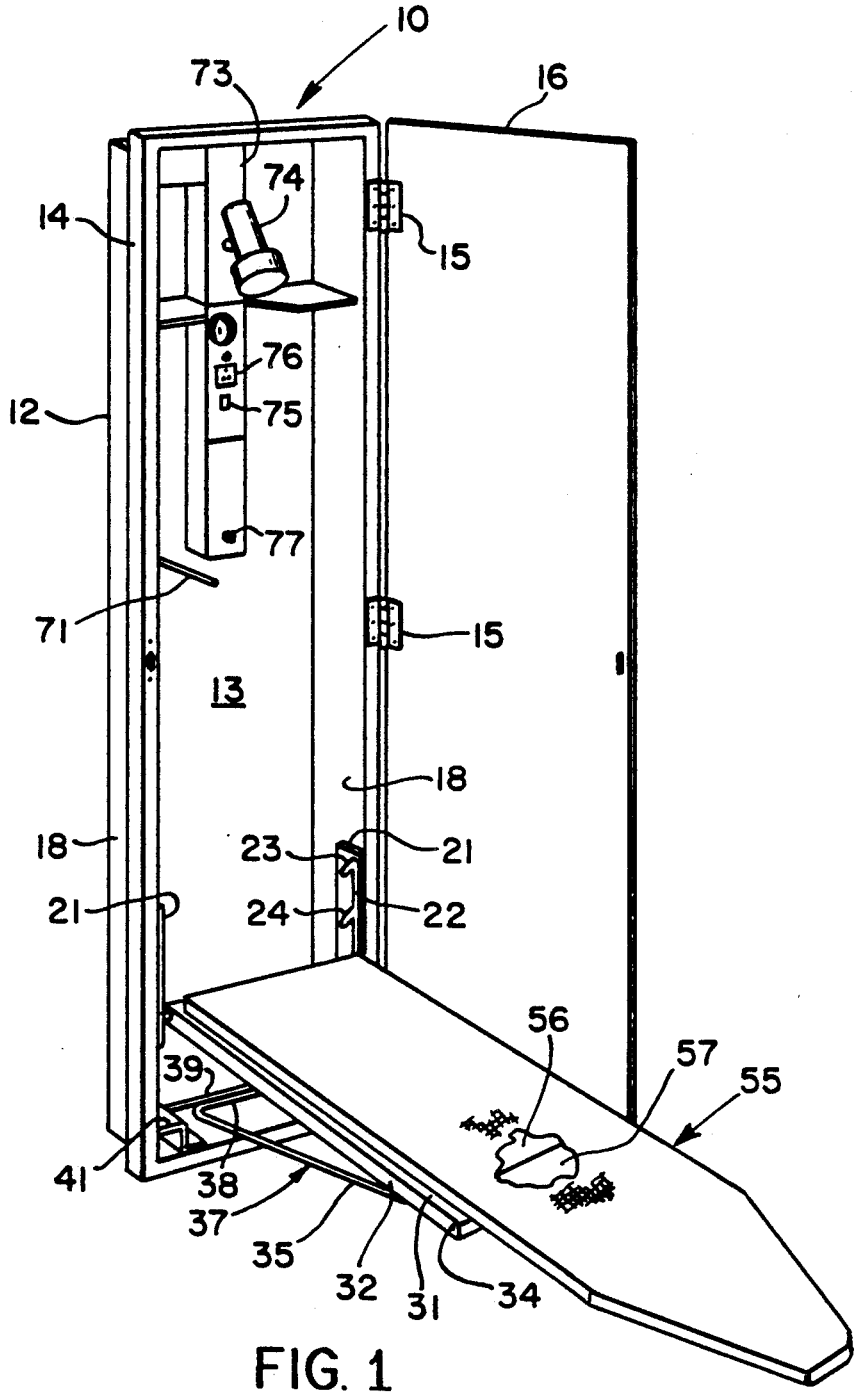
FIG. 1 is a perspective view of an ironing center or unit made according to one embodiment of this invention, the door of the cabinet which forms part of this unit being shown in its open position, and the foldable ironing board, which also forms a part of this unit, being shown in its erected or operative position, and with an ironing board cover thereon being cut away in part.

Referring now to the drawings by numerals of reference, and first to FIG. 1, 10 denotes generally a cabinet comprising an elongate, rather shallow, generally rectangularly shaped housing 12, which is closed at its lower end by a panel 13, and which is surrounded at its open end by a rectangularly shaped flange 14. Pivotally secured along one edge thereof by a plurality of hinges 15 to one edge of the flange 14 is a large, rectangularly shaped door 16, which is disposed to be swung between an open position as shown in FIG. 1, and a closed position (FIG. 2) in which it completely covers the open end of the housing. As shown in FIG. 2, housing 12 is adapted to be secured in a rectangularly shaped opening 17 in the wall W of a room, such as a kitchen or the like, so that the flange 14 overlies the outer surface of the wall.

Secured to the inside surfaces of the opposed side walls 18 of housing 12 adjacent its lower end are two, rectangularly shaped pivot pin supporting plates 21 (FIGS. 1 and 4). Each of the confronting surfaces of the plates 21 has formed therein adjacent its forward edge a vertically extending slot 22. Also formed in the face of each plate 21 to communicate at their upper ends with the upper end, the mid portion, and the lower end, respectively, of each slot 22, are three, vertically spaced, diagonally extending slots 23, 24 and 25. The lower, closed ends of these slots are disposed in vertically spaced, registering relation with each other.

Mounted to pivot adjacent its rear or left end (FIG. 4) between the plates 21 is an elongate ironing board support plate 31, which has a pair of integral, downwardly depending sidewalls 32. A pivot rod or pin 33, which passes adjacent opposite ends thereof through the sidewalls 32 of plate 31, has opposite ends thereof removably seated in the lower ends of the registering, pivot pin supporting slots 24, as illustrated in FIG. 4. However, if desired, the pivot pin 33 obviously may be shifted into any one of three, different, vertical positions corresponding to the bottoms of the slots 23, 24 and 25, respectively.

Adjacent the outer or right end of the plate 31 as shown for example in FIG. 4, its downwardly depending sidewalls 32 support opposite ends of another pivot pin 34. Pin 34 is secured intermediate its ends to the outer ends of the legs 35 and 36 of a generally U-shaped support bracket which is denoted generally by numeral 37. The inner or left end 38 of bracket 37 is fixed to still another pivot pin or rod 39 opposite ends of which are releasably and adjustably mounted in a pair of opposed angle plates 41, which are fastened to the inside surfaces of the cabinet side walls 18 adjacent the lower ends thereof. The vertical leg of each angle plate 41 has therein a first pair of slots 42 and 43, which intersect each other at right angles, and a third slot 44 which communicates adjacent its upper end with slot 43, and which extends diagonally downwardly therefrom.

In FIG. 4 rod 39 is shown in its intermediate position, wherein opposite ends thereof are seated in the bottoms of the registering slots 44 in plates 41. However, it will be readily apparent that rod 39 can be adjusted into at least two other positions in which opposite ends thereof seat slidably in the bottoms of the registering slots 42 or 43.

Mounted on the outer end of plate 31 is a lazy susan-type support in the form of a lower, rectangular plate 51 (FIGS. 3 and 4), which is fastened on the upper surface of plate 31, and an upper, similarly shaped plate 52, which is rotatably supported on plate 51 by a plurality of ball bearings (not illustrated) carried in a conventional, circular bearing race or housing 53 that is interposed between plates 51 and 52. Mounted on the plate 52 for limited rotational movement about the axis of the bearing race 53 is a foldable ironing board which is denoted generally by the numeral 55.

Board 55 comprises two, generally planar sections 56 and 57, which are hingedly connected together as noted hereinafter, so that the outer, pointed section 57 (the left hand section as shown in FIGS. 3 and 4) can be folded into a collapsed position in which it overlies the inner section 56 of the board. For this purpose the bottom of the board section 56 is secured adjacent its outer end to the upper surface of the rotatable plate 52. Adjacent its inner or left end as shown in FIGS. 3 and 4, the board section 57 is hingedly connected to the outer or right end of board section 56 by two sets of double acting hinges each of which sets is denoted generally by the numeral 60. As shown more clearly in FIG. 3, these two sets of hinges 60 are positioned adjacent to, and outwardly from, opposite sides, respectively, of the rotatable, bearing-supported plate 52. Since these double acting hinges 60 are identical in construction only one such hinge 60 has been illustrated in detail in FIGS. 5 and 6.

Referring now to FIGS. 5 and 6, each double acting hinge comprises a pair of spaced, parallel hinge pins 61 and 62, which extend at right angles to the axis of the bearing race 53. Pin 61 pivotally or hingedly connects together a first hinge plate 63, which is fastened to the underside of the board section 56 adjacent its outer end, and a second hinge plate 64, which projects at right angles downwardly from plate 63 when the board 55 is in its erected position as shown in FIG. 5. Pin 62 hingedly connects together one hinge plate 65, which is fastened to the underside of the board section 57 adjacent its inner end, and a second hinge plate 66, which extends downwardly and parallel to the hinge plate 64 when the board 55 is in its erected position (FIG. 5). The two hinge plates 64 and 66 are fastened in spaced, parallel relation to each other by a pair of right angle plates or brackets 67 and 68, which have overlapping legs extending between plates 64 and 66, and which are fastened together by a screw 69.

This hinge construction permits the outer or pointed section 57 of the ironing board 55 to be folded between an erected position in which its upper surface is substantially coplanar with the upper surface of the other board section 56 (FIGS. 3-5), and a collapsed or folded position (FIG. 6) in which section 57 is folded over and in spaced, overlapping, parallel relation to the other or inner board section 56. The board 55 can be folded into an inoperative position within the cabinet 10 by swinging the ironing board support 32 upwardly and counterclockwise in FIG. 4 about the axis of its pivotal support rod 33 until the now-folded board 55 is completely housed within the cabinet 10. During this swinging movement, and depending upon its position at that time, the support rod 39 is free to pivot in slots 42, or to be lifted upwardly out of the slots 43 or 44 of the brackets 41, and into a position in which opposite ends thereof register with the slots 42 in plates 41. At such time the board 55 will be completely folded into cabinet 10, and will be releasably held in such position 10 behind a flexible retaining finger 71 (FIG. 1), which projects from one side of the cabinet to overlie the collapsed board.

Whenever the board 55 is placed in use, its height can be adjusted simply by shifting the pivot rod 33 into either the lowermost slots 25 in plates 21, or into the intermediate slots 24, or the uppermost slots 23 of plates 21. In each of these three different positions the pivot rod 39 for the board supporting legs 35, 36 will be located either at the bottom of the slot 43 in plates 41, as when rod 33 is located in the bottom of slots 25, or rod 39 will be positioned in the bottom of slots 44 when rod 33 is seated in the slots 24; and, finally, in the uppermost position of the board 55, the ends of rod 39 will be seated in the closed ends of slots 42. Moreover, depending upon the size of the room into which the board 55 is erected, the board may be located in its full line position as shown in FIG. 3, in which case it projects at right angles outwardly from the wall W. Alternatively, board 55 may be swung ninety degrees in either direction, as indicated by the arrows in FIG. 3, about the axis of the race 53 into an alternative operating position, as shown for example by the broken lines in FIG. 3, wherein the length of the board 55 extends parallel to the wall W.

Mounted in cabinet 10 adjacent the upper end thereof is an elongate wiring compartment 73 (FIG. 1), which contains the necessary wiring for supplying power to a lamp 74, which projects from the outer face of the housing within cabinet 10 for the purpose of directing illumination onto the board 55, when the latter is in use. Lamp 74 is controlled by a manually operable switch 75, which is also mounted to project from housing 73 beneath a conventional 120 volt receptacle 76, which also opens on the face of housing 73. For safety purposes, a safety switch 77 projects from the face of housing 73 for engagement by the collapsed board, when the latter is enclosed within the housing behind the flexible finger 71. When engaged by the back of the folded or collapsed board 55, the switch 77 disconnects all power to lamp 74 and receptacle 76.

From the foregoing it will be apparent that the present invention provides a very compact and efficient unit which considerably simplifies and eases the ironing of clothing, or the like, in quarters or spaces which might otherwise be unsuitable for such an operation. The novel cabinet disclosed herein permits ready and simple storage of the ironing board, which, by use of double acting hinges, can be readily folded between collapsed and erected positions. Moreover, by mounting the board 55 on the bearing race of the type illustrated herein, it is possible for an operator to swing the board into a variety of angular positions relative to the associated wall in which the cabinet is mounted.

Moreover, while this invention has been illustrated and described in detail in connection with only certain embodiments thereof, it will be apparent that it is capable of still further modification, and that this application is intended to cover any such modifications as may fall within the scope of one skilled in the art, or the appended claims.

I claim:

1. A built-in ironing center, comprising a housing disposed to be mounted in a recess in the wall of a room, an ironing board comprising two interconnected sections, means mounting said board on said housing for swinging movement into and out of an opening in the front of said housing, and about a first horizontal axis between a collapsed position in which said board is disposed within said housing, and an erected position in which said board is positioned externally of said housing for angular adjustment about a vertical axis, one of said sections of said board being mounted for swinging movement in a horizontal plane about said vertical axis, when said board is in its erected position, and means hingedly connecting the other of said sections at one end thereof to one end of said one section for swinging movement about a pair of spaced, parallel hinge axes between a folded position in which said other section overlies and is parallel to said one section, and an unfolded position in which said other section extends beyond said one end of said one section and in coplanar relation with said one section, said means hingedly connecting together said sections comprising a first pair of hinge plates each of which is secured to a different one of said sections, and a second pair of plates pivotally connected to said first pair of plates and fixed in spaced, parallel relation to each other.

2. A built-in ironing center as defined in claim 1, including a lamp mounted in said housing adjacent the upper end thereof and operable to direct light onto said board when said board is in its erected position.

3. A built-in ironing center as defined in claim 1, wherein said mounting means for said board comprises a first member means adjustably mounting said first member at one end on said housing for swinging movement about said first horizontal axis between a collapsed position in which said first member is disposed within said housing, and an erected position in which said first member projects at its opposite end horizontally out of said housing at a predetermined height, and means supporting said one section of said board on said opposite end of said first member for rotation about said vertical axis.

4. A built-in ironing center as defined in claim 3, wherein said mounting means for said first member includes means for adjusting the predetermined height of said first member and therefore the ironing board mounted thereon.

5. A built-in ironing center as defined in claim 3, wherein said mounting means for said board further comprises a second member, means adjustably mounting one end of said second member in said housing for swinging movement about a second horizontal axis located beneath and parallel to said first horizontal axis, and means connecting the opposite end of said second member to said opposite end of said first member for pivotal movement about a third horizontal axis spaced from and parallel to said first and second horizontal axes.

6. A built-in ironing center as defined in claim 5, wherein said means mounting said one end of said first member on said housing comprises a first shaft defining said first horizontal axis, and adjustably supported adjacent opposite ends thereof in said housing for vertical adjustment in said housing into any one of several different vertical positions, and said means mounting said one end of said second member in said housing comprises a second shaft defining said second horizontal axis, and adjustably supported adjacent opposite ends thereof in said housing for vertical adjustment in said housing in response to the vertical adjustment of said first shaft in said housing.

7. A built-in ironing center comprising, a housing disposed to be mounted in a recess in the wall of a room, an ironing board comprising two interconnected sections, means mounting said board on said housing for swinging movement into and out of an opening in the front of said housing, and about a first horizontal axis between a collapsed position in which said board is disposed within said housing, and an erected position in which said board is positioned externally of said housing for angular adjustment about a vertical axis, one of said sections of said board being mounted for swinging movement in a horizontal plane about said vertical axis, when said board is in its erected position, and means hingedly connecting the other of said sections at one end thereof to one end of said one section for swinging movement about a pair of spaced, parallel hinge axes between a folded position in which said other section overlies and is parallel to said one section, and an unfolded position in which said other section extends beyond said one end of said one section and in coplanar relation with said one section, said means hingedly connecting together said ironing board sections comprising at least two hinges, each of which comprises a pair of plates pivotally connected to each other along a respective hinge axis, means securing together one plate each of said two hinges in spaced, parallel relation to each other, thereby to retain the hinge axes thereof in spaced, parallel relation, the other of the two plates of one of said hinges being secured to said one section of said board adjacent said one end thereof, and with the hinge axis of said one hinge extending transversely of said vertical axis, and the other of said hinges having the other plate thereof secured to said other section of said board adjacent said one end thereof.

8. A built-in ironing center comprising a housing disposed to be mounted in a recess in the wall of a room, an ironing board comprising two interconnected sections, means mounting said board on said housing for swinging movement into and out of an opening in the front of said housing, and about a first horizontal axis between a collapsed position in which said board is disposed within said housing, and an erected position in which said board is positioned externally of said housing for angular adjustment about a vertical axis, one of said sections of said board being mounted for swinging movement in a horizontal plane about said vertical axis, when said board is in its erected position, and means hingedly connecting the other of said sections at one end thereof to one end of said one section for swinging movement about a pair of spaced, parallel hinge axes between a folded position in which said other section overlies and is parallel to said one section, and an unfolded position in which said other section extends beyond said one end of said one section and in coplanar relation with said one section, said mounting means including means for releasably securing said board in its collapsed position within said housing, a door being pivotally connected to one side of said housing for swinging movement into and out of a closed position over said opening in the front of said housing, an electrical receptacle mounted in said housing adjacent said lamp, and a safety switch mounted in said housing and operable by said board, when said board is secured in its collapsed position by said securing means to prevent the supply of electrical power to said lamp and to said receptacle.

* * * * *